United States Patent [19]

Noack et al.

[11] 4,258,239

[45] Mar. 24, 1981

[54] ELECTRIC CIRCUIT BREAKER

[75] Inventors: Dieter Noack, Berlin; Winfried Oltersdorf, Maintal, both of Fed. Rep. of Germany

[73] Assignee: Siemens Aktiengesellschaft, Munich, Fed. Rep. of Germany

[21] Appl. No.: 870,067

[22] Filed: Jan. 17, 1978

[30] Foreign Application Priority Data

Jan. 27, 1977 [DE] Fed. Rep. of Germany ..... 2703550

[51] Int. Cl.[3] ..... H01H 33/88

[52] U.S. Cl. ..... 200/148 A; 200/148 R

[58] Field of Search ..... 200/148 A, 148 R

[56] References Cited

U.S. PATENT DOCUMENTS

| | | | |
|---|---|---|---|
| 3,939,317 | 2/1976 | Noack et al. | 200/148 A |
| 4,114,004 | 9/1978 | Dayet et al. | 200/148 A |

*Primary Examiner*—Robert S. Macon

*Attorney, Agent, or Firm*—Kenyon & Kenyon

[57] ABSTRACT

An improved electric circuit breaker of the type comprising: a first hollow stationary contact element; a second hollow movable contact element, a third movable tubular contact element for connecting the first and second contact elements in the on condition of the breaker; and a piston-cylinder arrangement for providing a flow of quenching medium to quench the arc drawn between the contact elements. The improvement includes the further provision in such a circuit breaker of a spring means for causing, during the closing of the breaker, the second contact element to move to a first position whereat it is spaced at a first distance from the first contact element and a further means including a movable portion of the piston-cylinder arrangement for causing, during the opening of the breaker, the second contact element to move to a second position whereat it is spaced at a second distance larger than the first distance from the first contact element.

7 Claims, 2 Drawing Figures

ELECTRIC CIRCUIT BREAKER

BACKGROUND OF THE INVENTION

1. Field of the Invention

This invention relates to an electric circuit breaker of a type comprising: a first hollow stationary contact element; a second hollow movable contact element; a third movable tubular contact element for connecting the first and second contact elements in the on position of the breaker; and a piston-cylinder arrangement for providing a flow of quenching medium to quench the arc drawing between such contacts.

2. Description of the Prior Art

In circuit breakers of the above type, the quenching gas flow is determined by the gas throughput of both the first and second hollow contacts or nozzles. The radial flow component of the quenching gas, which is directed toward the contacts and blasts the arc, increases in strength the closer the contacts are together. As a result, closely adjacent contacts permit the interruption of larger currents. On the other hand, when in the open condition, the breaker must be able to safely withstand switching and lightning surges, as well as higher ac voltages, (phase-to-phase voltage, phase opposition) which may be substantially higher than the crest value of the nominal voltage. This, in turn, requires that the distance between the contacts be as large as possible. To meet these requirements for high voltage during the open or off condition of the breaker and large current during the quenching condition thereof, which requirements contradict each other as far as the distance beween the first and second contacts is concerned, the movable second contact is moved between a first or quenching position during the quenching condition and a second or separation position during the open condition of the breaker.

More particularly, such a circuit breaker configuration is disclosed in the German Offenlegungsschrift No. 19 66 973. In this breaker, the movement of the second contact element is controlled by a reversing lever linkage which is rigidly coupled to the breaker drive. However, such a reversing or toggle lever linkage is very expensive, particularly for power circuit breakers with only a single gap, and requires a considerable amount of space.

It is, therefore, an object of the present invention to provide a circuit breaker of the above type wherein an inexpensive and compact arrangement is employed for movement of the movable second contact.

SUMMARY OF THE INVENTION

In accordance with the principles of the present invention, the above and other objectives are accomplished in an electric circuit breaker of the above type by further including therein a spring means for causing, during the closing of the breaker, the second contact element to move to a first position whereat it is spaced at a first distance from the first contact element, and a further means including a movable portion of the piston cylinder arrangement for causing, during the opening of the breaker, the second contact element to move to a second position whereat it is at a second distance larger than the first distance from the first contact element.

With the circuit breaker so configured, there is no need to employ any kind of reversal for the drive parts. The drive and the movable parts of the breaker can thus be moved in the same direction. As a result, a high-voltage power circuit breaker for voltages of 170 kV and more with only a single gap and a vertically oriented switching chamber can be constructed in a relatively simple and compact manner.

In the embodiment of the invention to be disclosed hereinafter the second contact element is further designed as a carrier for the blasting cylinder which forms the movable part of the piston-cylinder arrangement. Moreover, this contact element is provided with a conical limiting stop on its outer surface which in the second position of the contact engages a matching, stationary conical centering base. Use of the latter permits the blasting cylinder to be guided by the second contact in the course of closing the breaker substantially without play. As a result, impact of the opening of the blasting cylinder as it surrounds the first contact element is avoided with certainty. The unavoidable play of the sliding support of the second contact element with respect to the motion of the blasting cylinder is thereby rendered ineffective.

In the aforesaid disclosed embodiment, the breaker is further provided with a stationary terminal and with sliding contacts or current-carrying ribbons for connecting the stationary terminal to the second contact element. In this embodiment, the spring means is formed of a coil spring made of magnetizable material, e.g., unalloyed spring steel, and the sliding contacts or current-carrying ribbons are arranged externally or outside of the coil spring.

SUMMARY OF THE DRAWINGS

The above and other features and aspects of the present invention will become more apparent upon reading the following detailed description in conjunction with the accompanying drawings, in which.

DETAILED DESCRIPTION

Figure 1:
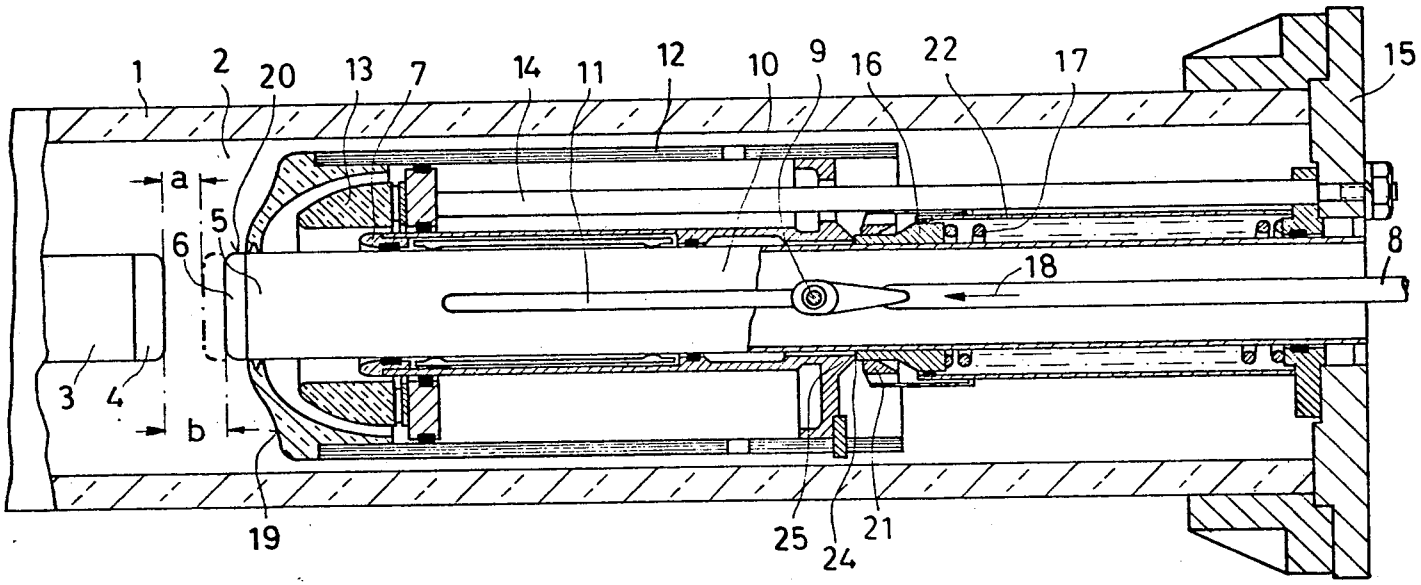
FIG. 1 illustrates schematically in longitudinal cross section an electric circuit breaker in accordance with the principles of the present invention.

FIG. 1 shows an electric circuit breaker comprising a switching chamber 1, the interior 2 of which is filled with a gaseous quenching and insulating medium which may, for example, be sulfur hexafluoride, under a pressure of, for instance, 5 bar. Disposed in the interior 2 of the switching chamber 1 is a first stationary contact element 3 which carries at its exposed end face an annular arc contact 4 of burnoff-resistant material. The arc contact 4 is part of a nozzle-shaped arrangement which, together with the otherwise hollow contact element 3, forms a discharge canal for switching gases. A second hollow movable contact element 5 is disposed coaxially with the contact 3 and likewise carries at its end face an annular arc resistance contact 6 which together with the element 5 also forms a discharge path for switching gases.

In the on position of the breaker, the contact element 5 is connected to the contact element 3 in an electrically conducting manner by means of a third movable tubular bridging contact element 7. The contact element 7 is driven by a drive rod 8, the latter drive rod being connected to a hydraulic or pneumatic drive (not shown) and being rigidly coupled to the bridging contact element 7 via a pin 9 disposed in the interior 10 of the tubular contact element 5. For this purpose, the contact element 5 is provided with longitudinal slots 11 which extend parallel to its axis and through which the pin 9 protrudes.

The pin 9 is also rigidly connected to a movable cylindrical tube 12, which forms the blasting cylinder of a piston cylinder arrangement which is provided for generating a flow of quenching medium. A stationary piston 13, cooperates with the cylinder 12 and is supported via rods 14 at stationary parts of the switching chamber 1.

As shown in FIG. 1 the contact element 5 is slidably supported within the switching chamber 1 in a support flange 15. The contact element 5 can thus be axially moved. It is further provided with a projecting ring 16 which is acted upon by a compression spring 17 which is braced against the flange 15. During the closing of the breaker, the force of the spring 17 moves the contact element from its off or separation position corrresponding to the off position of the breaker to a second position shown in dash-dotted line corresponding to the quenching position of the breaker. In this second position the contact 5 is spaced at a distance a (the quenching distance) from the contact 3.

The slots 11 are designed at their ends away from the gap between the contacts 3 and 5 in such a way that during the opening of the breaker the contact element 5 is transferred by the pin 9 acting as a driver to its off or separation position whereat it is spaced at a distance b from the contact 3.

As can be appreciated, during the closing of the breaker, the rod 8 and, therefore, the pin 9 are moved in the direction of the arrow 18. As a result, as above noted, the contact element 5 is transferred under the force of the spring 17 into its quenching distance position. In the further course of closing the breaker, the opening 20 in the end face 19 of the blasting cylinder 12 is moved into surrounding relationship to the contact 3. As the contact element 5, together with the rods 14, guide the blasting cylinder 12 as well as the bridging contact 7 into such surrounding relationship, play, in the sliding support of the contact element 5, can lead to a situation where the blasting cylinder 12 and the bridging contact 7 are not exactly coaxial to the contact element 3. To ensure proper alignment, the ring 16 is thus provided on its outer surface with a conical portion which engages with a matching, stationary conical centering seat 21, as can be seen particularly well in FIG. 2. As this engagement takes place at a time when the blasting cylinder 12 has not yet reached the stationary contact element 3, automatic centering of the cylinder 12 and the contact 7 is achieved.

Figure 2:
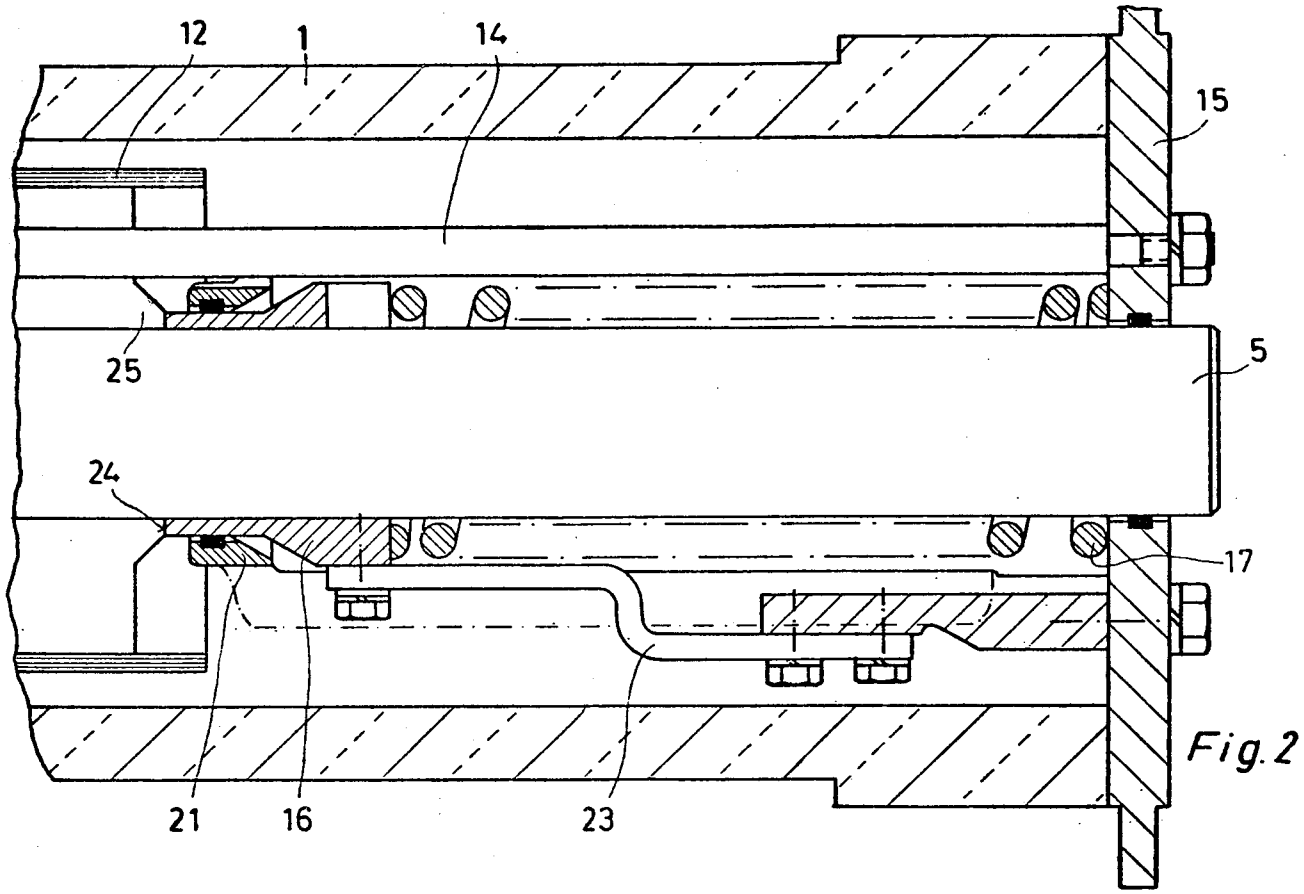
FIG. 2 shows an exploded view of a modified portion of the breaker of FIG. 1.

In the embodiments of the invention shown in FIGS. 1 and 2, current is conducted from the stationary terminals of the breaker, which are connected to the stationary flange 15, via sliding contact elements 22 and via current-carrying ribbons 23, respectively. Both current-carrying connections 22 and 23 are arranged outside or exteriorally of the spring 17, which is advantageously of coil spring configuration. The spring 17 is, therefore, relieved of eddy currents, so that normally used spring steel can be employed.

With the circuit breaker of the invention designed as aforesaid, the motion control in the vicinity of the drive 8 can be kept relatively inexpensive and compact.

In a further modification of the invention, it should be noted that the driver members 9 and 12 of FIG. 1 can be replaced by a stop shoulder 24 disposed on the ring 16 used in cooperation with an annular driver 25.

What is claimed is:

1. In an electrical circuit breaker of the type in which electrical arcs are quenched by blasting with a gas during opening of the breaker and which includes a first stationary contact element; a second axially-movable contact element slidably mounted in support means in the breaker and disposed coaxially and in opposing relationship with respect to said first contact element, said second contact element being movable during opening of the breaker between a first arc-quenching position and a second separation position, said arc-quenching position being axially closer to said first stationary contact element than said second separation position; a third tubular contact element disposed coaxially around and in engagement with said second contact element and movable axially into engagement with said first contact element for bridging and electrically connecting said first and second contact elements during closing of the breaker; and means for moving said third movable contact element into engagement with said first contact element during closing of the breaker and for providing a flow of a gaseous quenching medium under pressure between said first and second contact elements during opening of the breaker for quenching arcs drawn between said first and second contact elements during separation of said elements; the improvement comprising:

first means disposed coaxially around and coupled to said second movable contact element;

second means disposed coaxially around said second movable contact element axially adjacent to said first means and in a position axially closer to said first stationary contact element than said first means, said second means being mounted in said breaker in a fixed position with respect to said second contact element and said first means, and said first means and said second contact element being movable with respect to said second means; and spring means, disposed in engagement with said support means and said first means, for biasing said first means into engagement with said second means, and thereby said second movable contact element into said arc-quenching position during closing of said breaker, said first means being further disposed in relationship to said third tubular contact element so as to be engaged by said contact during opening of said breaker and bias said first means out of engagement with said second means, and thereby said second movable contact element into said separation position.

2. The improvement recited in claim 1, wherein said first means comprises ring means having a conically-shaped outer surface tapered axially towards said first stationary contact element, and wherein said second means comprises ring means having a conically-shaped inner surface corresponding in shape to that of said outer surface of said first means for engaging said first means when said second movable contact element is disposed in said arc-quenching position during closing of said breaker.

3. The improvement recited in claim 2, further comprising slidable contact means, coaxially disposed around said second movable contact element and disposed in engagement with said support means and said first ring means, for electrically connecting said second movable contact element to said support means, said support means comprising a stationary electrical terminal of said breaker.

4. The improvement recited in claim 3, wherein said slidable contact means are disposed coaxially around said spring means.

5. The improvement recited in claim 2, further comprising electrically conductive ribbon members, coupled to said support means and said first ring means, for electrically connecting said second movable contact element to said support means, said support means comprising a stationary electrical terminal of said breaker.

6. The improvement recited in claim 5, wherein said spring means is disposed between said ribbon members and said second movable contact element in said breaker.

7. The improvement recited in claim 2, wherein said spring means comprises a coil spring disposed coaxially around said second movable contact element and is fabricated of a magnetizable material.

* * * * *